United States Patent [19]

Willis

[11] Patent Number: 5,072,463

[45] Date of Patent: Dec. 17, 1991

[54] EZ ACCESS BED

[76] Inventor: William J. Willis, P.O. Box 184, Westhampton Beach, N.Y. 11978

[21] Appl. No.: 683,699

[22] Filed: Apr. 11, 1991

[51] Int. Cl.[5] ..... A61G 7/00

[52] U.S. Cl. ..... 5/62; 5/66; 5/68

[58] Field of Search ..... 5/60, 62, 66, 69

[56] References Cited

U.S. PATENT DOCUMENTS

| | | | |
|---|---|---|---|
| 525,959 | 9/1894 | Martin . | |
| 961,273 | 6/1910 | Ward . | |
| 1,428,462 | 9/1922 | Ward . | |
| 1,529,699 | 3/1925 | Hawk . | |
| 2,887,691 | 5/1959 | Talarico et al. | 5/68 X |
| 3,149,349 | 9/1964 | Nelson | 5/66 |
| 3,262,133 | 7/1966 | Beifzel | 5/66 |
| 3,609,777 | 10/1971 | Agnew et al. | 5/62 |
| 3,997,926 | 12/1976 | England | 5/62 |
| 4,227,269 | 10/1980 | Johnston | 5/66 |
| 4,613,997 | 9/1986 | Langdale | 5/62 |
| 4,685,159 | 8/1987 | Oetiker | 5/62 X |
| 4,847,929 | 7/1989 | Pupovic . | |

*Primary Examiner*—Michael F. Trettel
*Attorney, Agent, or Firm*—Leonard Belkin

[57] ABSTRACT

A bed which is articulated in two places capable of placing the occupant in an infinite number of positions including the standing position. The bed has a head portion and an intermediate portion both of which rotate about a shaft. A foot portion of the bed rotates about a second shaft. The bed pivots about a third shaft supported by the frame. Two power drives are provided, one for the head portion and the other for the foot and intermediate portions. A pantograph arrangement connected to the second power drive rotates the foot portion. The occupant is raised to a standing position by having the foot end of the bed touch the floor and raise the foot end of the frame off the floor.

9 Claims, 3 Drawing Sheets

EZ ACCESS BED

BACKGROUND OF THE INVENTION

The present invention relates to a bed and more particularly to a bed having a high degree of mobility.

As the population ages there are increasing numbers of persons in institutions and at home who require bed care. The handling of these persons presents problems of moving them from one place to another and also of positioning them on their beds to carry out bodily and other functions. This increases the demands on the personnel who provide the services and the care required. During a time of fiscal and budgetary restraints, as well as shortages of personnel willing to perform these functions, there is great impetus for finding ways of carrying out these needed functions with far few persons.

For a long period of time, the special needs of bedded patients and other persons have been recognized and efforts have been exerted to develop specialized beds to assist workers and others to perform the functions enumerated above. The following United States Patents illustrate some of these efforts.

U.S. Pat. No. 525,959 issued in 1894 illustrates a bed which is movable into a sitting position.

U.S. Pat. No. 961,273 shows a bed for an invalid having multiple positions.

U.S. Pat. No. 1,428,462 discloses a bed which is segmented.

U.S. Pat. No. 1,529,699 illustrates an adjustable hospital bed on wheels articulated in two places.

U.S. Pat. No. 4,613,997 shows a vertical access convalescent bed adjustable between horizontal and vertical positions.

U.S. Pat. No. 4,847,929 discloses a bed with adjustable positions to permit the taking of X-rays of the patient.

None of the preceding patents teaches the present invention.

SUMMARY OF THE INVENTION

In this invention there is provided an easy access bed which comprises a completely mobile bed care system having improved mobility, comfort and convenience for both the patient and the person assisting the patient.

A preferred embodiment of this invention comprises a bed with five basic positions and being infinitely variable between those positions. These positions include the normal sleeping position, the head raised above the legs, the legs raised above the head, sitting position, and standing (i.e., for transfer to a walker, or for walking). The bed is completely powered, and can be operated either remotely or by the patient himself.

Other features of the bed incorporating the principles of this invention include simplicity and reduced cost of construction and compact design requiring less space for use than some existing hospital bed designs.

It is thus a principal object to provide an improved bed for institutional and home use capable of great mobility.

Other objects and advantages of this invention will hereinafter become obvious from the following description of preferred embodiments of this invention.

DESCRIPTION OF THE PREFERRED EMBODIMENTS

Figure 1:
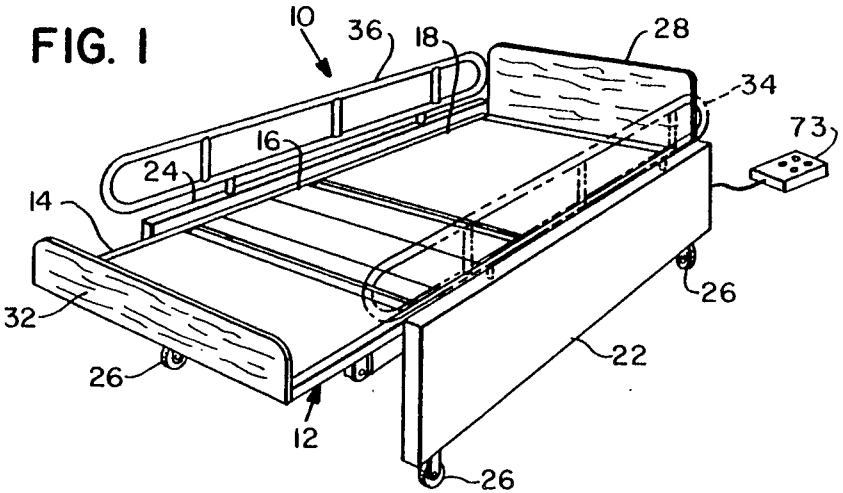
FIG. 1 is an isometric view of a preferred embodiment of this invention.

Referring to FIG. 1, bed 10 consists of a platform 12 made up of by three segments, namely, foot segment 14, intermediate segment 16, and head segment 18.

Platform 12 is supported by a frame consisting of a pair of sideboards 22 and 24 mounted on legs having wheels or casters 26 permitting bed 10 to be moved around.

Figure 7:
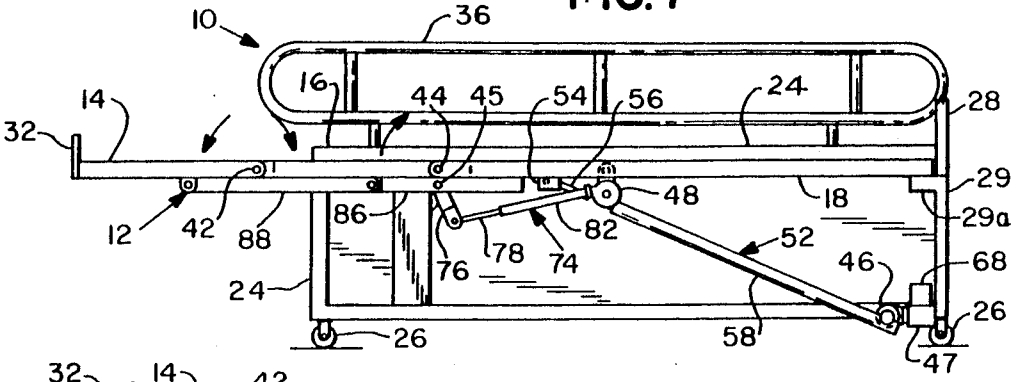
FIG. 7 is a side elevation view of the bed in the position shown in FIG. 1 with one sideboard removed for clarity.

Bed 10 is also provided with a headboard 28 mounted on panel 29 seen in FIG. 7 which is attached to sideboards 22 and 24, while foot segment 14 has a footboard 32 mounted on the end thereof. Panel 29 is provided with a shoulder **29*a* (seen in FIG. 7) which limits the clockwise rotation of platform 12 when all four casters 26 are on the floor. A pair of removable safety rails 34 and 36 are mounted on sideboards 22 and 24, respectively. FIG. 1 illustrates one of the five basic positions of bed 10**.

Figure 2:
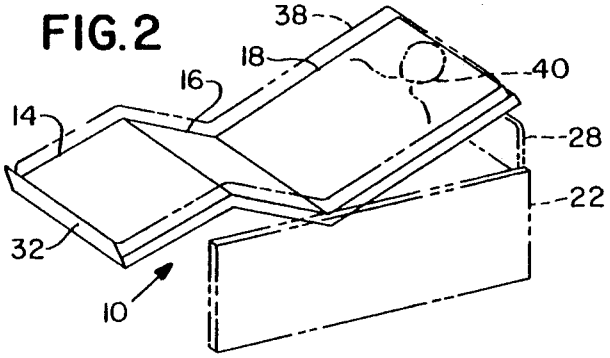
FIGS. 2–6 illustrated schematically the basic positions of the bed shown in FIG. 1.
Figure 3:
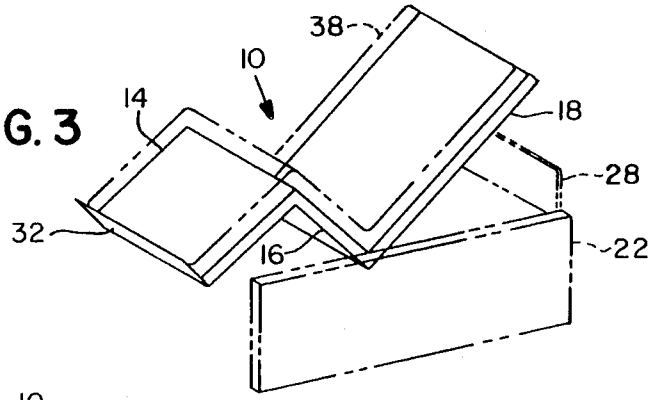

Before describing the mechanism for articulating bed 10, reference is made to FIGS. 2 to 6 illustrating schematically the basic configurations of the ted including the normal position shown in FIG. 1, with mattress 38 shown in phantom. FIG. 2 is a variation between the positions shown in FIGS. 1 and 3. As seen in FIG. 2, patient 40 is in a position with his back and knees slightly raised. A more pronounced position of this type shown in FIG. 3 with the head above the legs to illustrate that the bed is infinitely variable in all of these positions.

Figure 4:
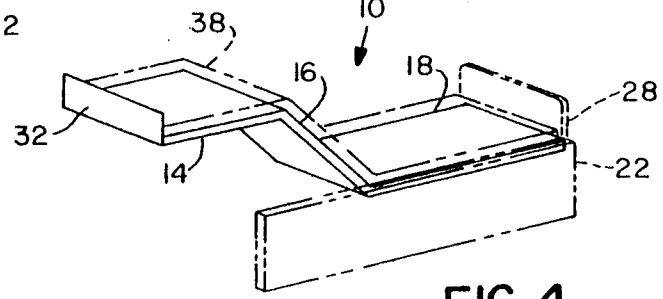
Figure 5:
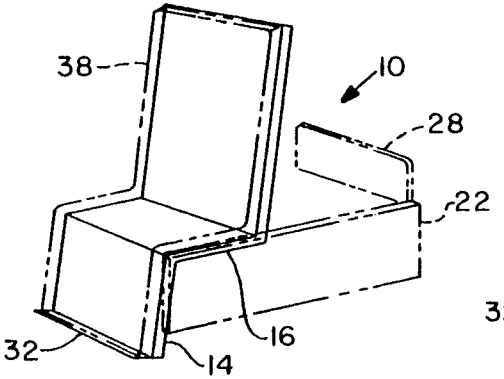
Figure 6:
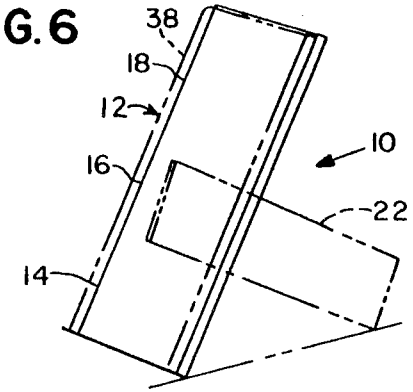

FIG. 4 shows bed 10 with the patient's legs raised above the rest of his body. FIG. 5 illustrates the sitting position of the patient, while FIG. 6 shows bed 10 almost is a vertical position where the patient is standing and can walk away from the bed, with or without a walker, without any strenuous effort on his part.

For the details of construction which is capable of producing the articulation of the bed just described, reference is made to FIGS. 7 to 10.

It will be seen that segments 14, 16, and 18 of platform 12 are joined by shafts 42 and 44 in a manner which permits rotation in the manner illustrated by the arrows in FIG. 7. A separate shaft 45 below shaft 44 is also attached to sideboards 22 and 24 in a manner to be more particularly described below so that rotation of all segments 14, 16, and 18 together in effect takes place around shaft 45.

With regard to the articulation of the platform segments about shafts 42 and 44, the latter shafts are provided with means which will be described later which limit the rotation of the segments so that when platform 12 is fully extended as illustrated in FIG. 7, segment 16 can only be swung upwardly as shown by the arrow arranged around shaft 44, and segments 14 and 16 can only be swung downwardly as shown by the arrows arranged around shaft 42.

Figure 11:
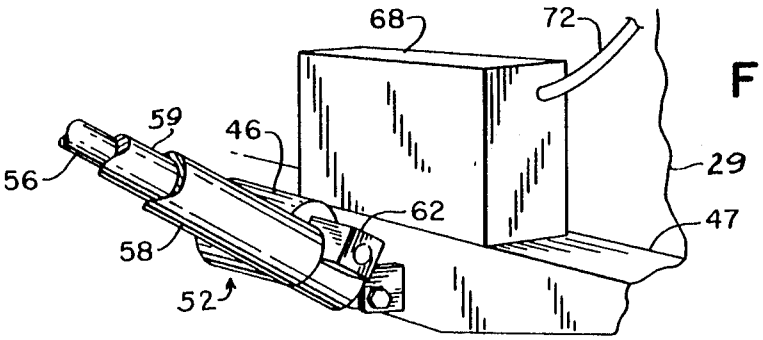
FIG. 11 is a detail view in perspective of the motor drive mounted on the headboard panel.

Two electric motors 46 and 48 produce all of the articulated positions of bed 10. Motor 46 is mounted on panel 29 having a shelf 47 located on panel 29 adjacent the bottom thereof, as also shown in FIG. 11, and connected by way of a drive mechanism 52 to a bracket 54 on segment 18. Mechanism 52 comprises a rod 56 extending from a cylinder 58 having a sleeve 59 rotated by a worm gear arrangement 62 of conventional design to rotate sleeve 59 to cause rod 56 to extend or retract depending on the direction of rotation of motor 46. The details of such an arrangement are conventional and do not form a part of this invention. Also mounted on shelf 47 is unit 68 powered by power line 72 from a control box 73 (see FIGS. 1 and 9) to change 110 volt AC to low voltage DC to operate motors 46 and 48. Control box 73 has two pair of switches **73*a* and 73*b* and switches 73*c*, 73*d* to control motors 46 and 48 separately, which switch being pressed determining the direction of rotation of the motors. For example, switches 73*a* and 73*b* operate motor 46, each switch indicating one direction of rotation. Control box 73** may be used by an attendant or by the patient himself.

Figure 8:
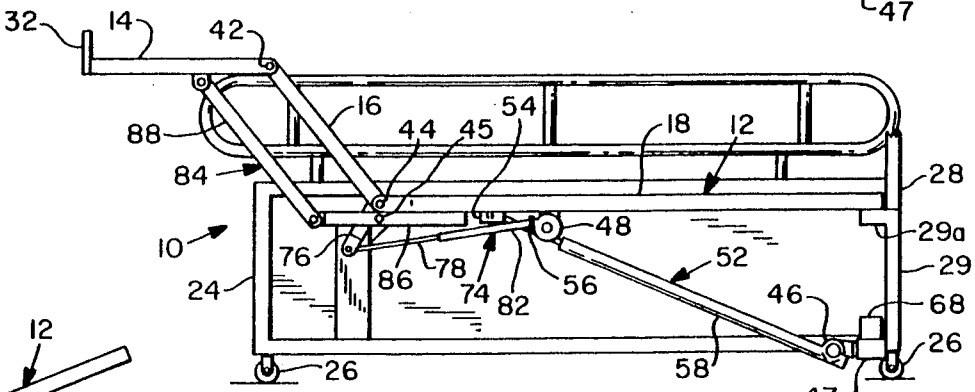
FIG. 8 is a view similar to FIG. 7 with the foot portion raised as seen schematically in FIG. 3.
Figure 9:
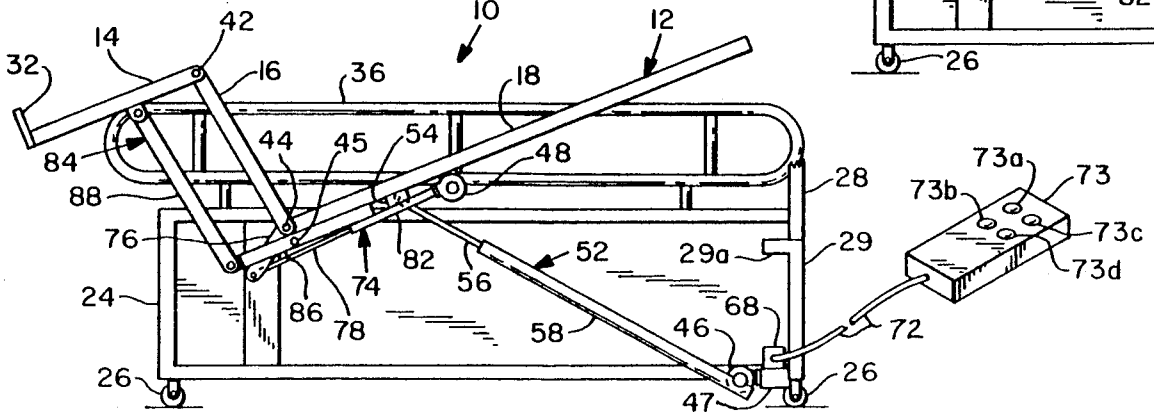
FIG. 9 is a view similar to FIG. 7 with the bed articulate in the manner shown schematically in FIG. 2.

Motor 48 is mounted on segment 18 and is connected by way of a drive mechanism 74 to an arm 76 connected to and extending from segment 16 as more clearly seen in FIGS. 8 and 9. Mechanism 74 comprises a rod 78 extending from a cylinder 82 having a similar arrangement as just described for effecting the extension and retraction of rod 78 depending on the direction of rotation of motor 48.

Figure 12:
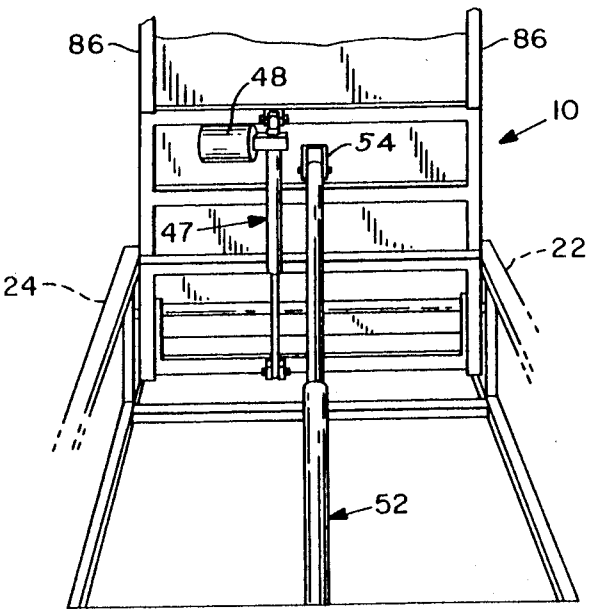
FIG. 12 is a view in the direction of 12 shown in FIG. 10.

It will also be noted that there is a pantograph arrangement 84 connecting segments 14 and 18. Arrangement 84 comprises a pair of rods 86 on opposite sides of segment 18 as also seen in FIG. 12, joined to a pair of rods 88 pivoted at one end on segment 14 and the other end on one end of each of rods 86. Shaft 45 passes through rods 86 and as previously indicated is supported on each end by sideboards 22 and 24. Platform 12 in effect pivots about shaft 45. Thus, as seen in FIG. 8, when electric motor 48 is energized to extend rod 78 and rotate segment 16 through its arm 76, pantograph arrangement 84 will cause segment 14 to rise as illustrated.

When electric motor 46 is energized to extend rod 56, segment 18 will be rotated counterclockwise around shaft 45 producing the configuration shown in FIG. 9. By extending rod 56 still further, then bed 10 will put the patient in a sitting position as shown in FIG. 5.

It will also be seen that pantograph arrangement 84 limits the range of motion of segments 14 and 16 with respect to each other as indicated by the arrows arranged around shaft 42, and that arm 86 attached to segment 18 limits the range of motion of segments 16 and 18 with respect to each other, these ranges having been previously described.

Figure 10:
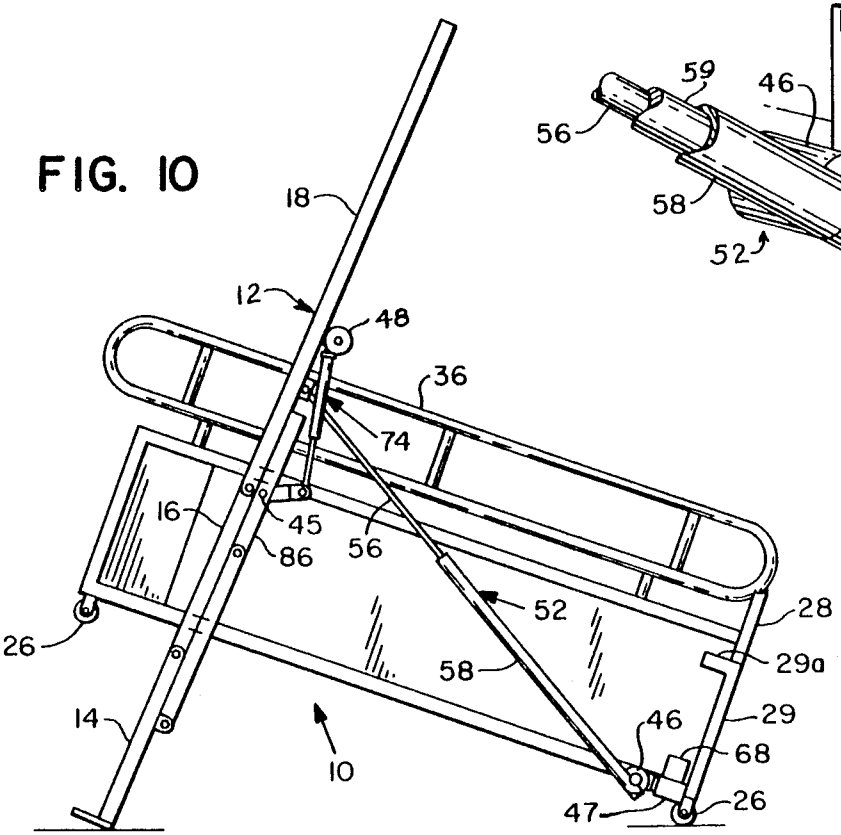
FIG. 10 is a view similar to FIG. 7 with the bed raised in the manner shown schematically in FIG. 6.

To move the patient into a standing position shown in FIG. 6, starting from the position of bed 10 shown in FIG. 7, motor 46 is energized to extend rod 56, platform 12 rotating to the position illustrated in FIG. 10. In this configuration of bed 10 it will be seen that the foot end of platform 12 contacts the floor and the legs at the foot end of bed 10 are lifted off the floor.

It is readily seen from the above description and the drawings that a very simple yet novel arrangement is provided capable of producing a variety of positions for the patient. The easy access bed as described is a completely mobile bed care system providing greater mobility, comfort and convenience than present bed systems now available.

The novel bed of this invention has infinite degrees of movement between all of the basic positions described and yet only a simple hand held control box with two switches is all that is required to produce all of the described positions. At the same time, the construction is simple and economical, with a low maintenance, rugged functional design, and occupies less space than many institutional beds now in use.

While only a certain preferred embodiment of this invention has been described, it is understood that many variations are possible without departing from the principles of this invention as defined in the claims which follow.

What is claimed is:

1. A bed comprising extended platform means extending from a right end to a left end for supporting thereon a mattress and an occupant of said bed, said platform means comprising a head segment at the right end, a foot segment at the left end, and an intermediate segment in between the head and foot segments, first shaft means joining the head and intermediate segments permitting said intermediate segment to be rotated with respect to said head segment, second shaft means joining the foot and intermediate segments permitting said foot segment to be rotated with respect to said intermediate segment, third shaft means mounted on said head segment, frame means supporting said third shaft means for rotating said platform means around said third shaft means, said frame means having head and foot leg means for supporting said bed on a floor and having headboard means adjacent the head end of said platform means attached to said head leg means and having means to limit the rotation of said platform means in the clockwise direction to the horizontal position when said head and foot leg means are supported on a floor, first power means for rotating said intermediate segment about said first shaft means, second power means for rotating said head segment about said third shaft means capable of putting said occupant in a standing position when all of said segments are in a common plane, and pantograph means for rotating said foot segment with respect to said intermediate segment in response to rotation of said intermediate segment by said first power means.

2. The bed as described in claim 1 in which said pantograph means comprises an arm attached to the bottom of said head segment supporting said third shaft means and extending toward the foot of said bed, and a rod pivotally connected at one end to the extended end of said arm and pivotally connected at the other end to a point along the length of said foot segment.

3. The bed as described in claim 2 in which said second power means comprises an electric motor mounted on said headboard means and extensible rod means between said electric motor and a point along the length of said head segment so that as said rod means is extended and retracted said head segment is rotated about said third shaft means.

4. The bed as described in claim 1 in which the foot end of said platform means comes into contact with the floor and raises the foot end of said frame means off the floor in order to place said occupant in a standing position.

5. A bed comprising an extended frame means extending from a right end to a left end supported on a floor at corresponding head and foot ends thereof, extended platform means for supporting thereon a mattress and an occupant of said bed, said platform means having a head segment at the right end and supported by first shaft means permitting the remainder of said platform means to rotate with respect to said head segment, second shaft means supporting said platform means, said frame means supporting said second shaft means for rotation, said frame means having headboard means adjacent the head end of said platform and having means to limit the rotation of said platform in the clockwise direction, first power means for rotating said platform means about said second shaft means for positioning said occupant in infinite steps from horizontal position raising the head end of said platform means until the foot end of said platform means contacts the floor and raises the foot end of said frame means off the floor until said occupant is raised into a substantially standing position.

6. The bed of claim 5 in which said platform means is further articulated by having a third shaft means between the first shaft means and the foot end of said platform means forming an intermediate portion of said platform means between said first and second shaft means and permitting the foot end of said platform means to be rotated around said third shaft means permitting the legs of said occupant to be raised.

7. The bed of claim 6 having second power means mounted on the head end of said platform means for rotating the foot end of said platform means.

8. The bed of claim 7 in which said second power means includes means to drive said intermediate portion of said platform means around said second shaft means and having pantograph means joining the head segment and the foot end of said platform means to cause the foot end to rotate with respect to said intermediate portion.

9. The bed of claim 8 having a control means for exercising control over said first and second power means, said control means having first switch means to control the direction of movement of said first power means and a second switch means to control the direction of movement of said second power means, the manipulation of both of said switch means permitting said bed to articulate in infinite positions between horizontal, vertical and sitting positions of said platform means.

* * * * *